United States Patent [19]

Thomas, Jr. et al.

[11] Patent Number: 4,937,997

[45] Date of Patent: Jul. 3, 1990

[54] OPEN WEB Z-SHAPED STRUCTURAL METAL BEAM

[76] Inventors: William G. Thomas, Jr., 1718 Castlerock, Houston, Tex. 77090; John C. Gussett, 11807 Dover, Houston, Tex. 77031; Clarke H. Stevenson, 1006 Lodge Hill, Houston, Tex. 77090

[21] Appl. No.: 327,700

[22] Filed: Mar. 23, 1989

Related U.S. Application Data

[63] Continuation-in-part of Ser. No. 31,799, Mar. 30, 1987, abandoned.

[51] Int. Cl.[5] ..... E04C 3/02

[52] U.S. Cl. ..... 52/693; 52/732

[58] Field of Search ..... 52/693, 694, 634, 695, 52/732

[56] References Cited

U.S. PATENT DOCUMENTS

| | | | |
|---|---|---|---|
| 954,900 | 4/1910 | Stragiotti | 52/694 |
| 1,101,189 | 6/1914 | Kahn et al. | 52/695 |
| 1,232,463 | 7/1917 | Gilbert | 52/634 |
| 1,763,300 | 6/1930 | Gilbert | 52/634 |
| 1,918,346 | 7/1933 | McHose | 52/694 |
| 2,010,971 | 8/1935 | Thomson | 52/695 |
| 2,147,695 | 2/1939 | Clauss | 52/732 |
| 3,106,995 | 10/1963 | Abramson | 52/694 |
| 3,740,917 | 6/1973 | Wong | 52/694 |

FOREIGN PATENT DOCUMENTS

| | | | |
|---|---|---|---|
| 156229 | 5/1953 | Australia | 52/693 |
| 702898 | 2/1965 | Canada | 52/694 |
| 153492 | 2/1956 | Sweden | 52/693 |

*Primary Examiner*—James L. Ridgill, Jr.
*Attorney, Agent, or Firm*—Kenneth A. Roddy

[57] ABSTRACT

An open web metal structural beam for use in building construction has a generally Z-shaped transverse cross section and is capable of being nested and joined in a lapped position with like beam members. The beam has a top chord defined by an elongate longitudinal angle having an L-shaped transverse cross section, a bottom chord member defined by an elongate longitudinal angle having an L-shaped transverse cross section. The top and bottom chords are secured by an open web member in vertically opposed relation with the vertical leg portions of the L-shapes aligned vertically and horizontal leg portions of the L-shapes in laterally opposed relation and the laterally opposed longitudinal edges of the horizontal leg portions of the L-shapes are bent to form vertically opposed longitudinally extending stiffener lips on the chord members. One or more metal angle members welded vertically between the vertical legs of L-shaped chord members on the side opposite the web increase the rigidity of the structural beam. The open web is formed of one or more metal bars secured at longitudinally spaced intervals between the vertical leg portions of the L-shaped top and bottom chord members in a longitudinally extending diagonal configuration extending between the top and bottom chords. The Z-shaped beams may be nested for shipping and joined together to span greater distances than the single beams alone.

10 Claims, 4 Drawing Sheets

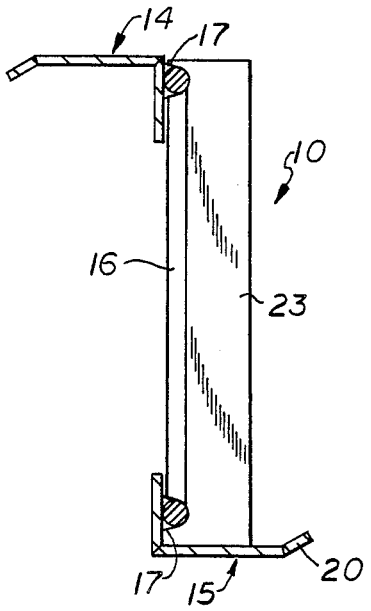
FIG. 7A
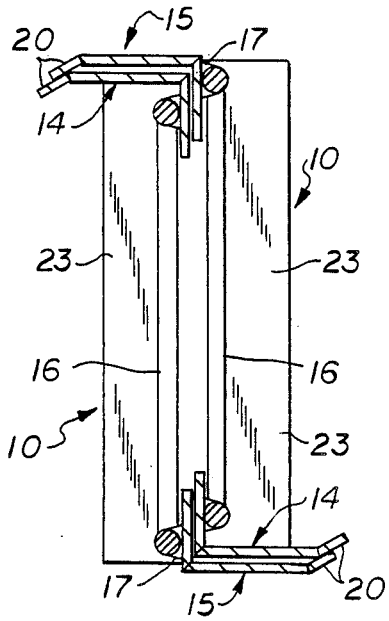
FIG. 7B
FIG. 8A
(PRIOR ART)
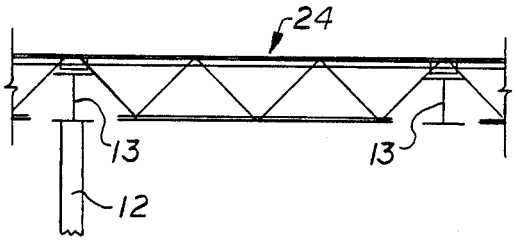
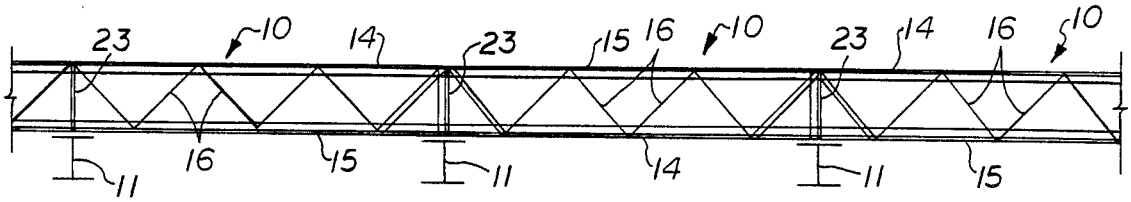
FIG. 8B

OPEN WEB Z-SHAPED STRUCTURAL METAL BEAM

CROSS REFERENCE TO RELATED APPLICATION

This application is a continuation-in-part of co-pending U.S. Pat. application Ser. No. 031,799, Mar. 30, 1987, now abandoned.

BACKGROUND OF THE INVENTION

1. Field of the Invention

This invention relates generally to structural members, and more particularly to an open web Z-shaped metal structural beam capable of being nested and joined together in a lapped condition with like beams to form a continuous beam.

2. Brief Description of the Prior Art

The low-rise, commercial-industrial, retail building industry represents approximately two billion dollars in sales or about ten billion dollars of in-place cost yearly (1987 dollars). The conventional building construction industry currently relies primarily on the "bar joist" for use as a secondary simple span roof structural member in metal buildings. The "bar joist" is an open web structural configuration comprised of a top and bottom angle members connected by diagonal rod webs welded therebetween.

The metal building industry is a rival to the conventional construction industry and has been able to capture about 50 percent of the commercial-industrial building market or about 1 billion dollars in sales. The metal building industry currently relies primarily on a solid web "Z-purlin" as a secondary continuous span roof structural member in metal buildings, and combinations of other structural members such as metal main frames, girts, and thin walled metal sheeting to replace the conventional building structure. The Z-purlin is a solid web structural configuration comprised of a beam having a Z-shaped cross section having a top and bottom flange portion integrally connected by a solid flat web and are capable of being nested or overlapped. The laterally opposed longitudinal edges of the top and bottom flange portions may be inclined at an angle to form a stiffiner lip for increasing the strength of the flanges relative to the web portion.

Although the bar joist and Z-purlin are considered "secondary" members, they represent approximately 15 percent of the cost of the structurals in a building. There are several patents which disclose structural bar joist or Z-purlin members of various constructions.

Lowe, U.S. Pat. No. 4,461,134 discloses a Z-purlin beam formed or relatively thin roll-formed sheet metal having a generally Z-shaped cross section with a top and botton flange portion integrally connected by a solid flat web and has longitudinally extending or vertically spaced stiffening members at the juncture of the web and flange portions. The Lowe Z-purlin is capable of being nested or overlapped in inverted stacked relation for shipping. There is no suggestion of an open web.

Goeltz, U.S. Pat. No. 1,911,018 discloses an intertruss structural unit formed by welding iron or steel shapes or rods into interlaced truss members. Some of the basic strutural members which make up the primary and secondary trusses are open web configurations comprised of a top and bottom chord members connected rods welded therebetween. The chords are elongate longitudinal flanges, angles, or channels, and have various conventional cross sectional shapes, such as L-shapes, sideways Z-shapes, and T-shapes. The Goeltz structural members do not have a generally Z-shaped cross section and are not believed capable of being nested or overlapped, and there is no suggestion of providing a stiffener lip or edge on the chord members.

Thomson, U.S. Pat. No. 2,010,971 discloses a open web Z-stud beam formed of either sheet metal having a generally Z-shaped cross section with a top and bottom flange portion integrally connected by a slitted expanded web extending therebetween, or top and bottom L-shaped angle members connected rods welded therebetween.

Macomber, U.S. Pat. No. 2,457,250 discloses a tubular section generally open web structural joist member having a V-section top chord and a bottom chord formed of parallel tubular members with rods welded between the top and bottom chord members.

Smith, U.S. Pat. No. 3,670,471 discloses a sectional tower structure of triangular transverse section having detachable brace members on one side which can be stacked in nested relation when the braces along one side are detached.

The present invention is distinguished over the prior art in general, and these patents in particular by an open web metal structural beam having a generally Z-shaped transverse cross section and is capable of being nested and joined in a lapped position with like beam members. The beam has a top chord defined by an elongate longitudinal angle having an L-shaped transverse cross section, a bottom chord member defined by an elongate longitudinal angle having an L-shaped transverse cross section. The top and bottom chords are secured by an open web member in vertically opposed relation with the vertical leg portions of the L-shapes aligned vertically and the horizontal leg portions of the L-shapes in laterally opposed relation and the laterally opposed longitudinal edges of the horizontal leg portions of the L-shapes are bent to form vertically opposed longitudinally extending stiffener lips on the chord members. One or more metal angle members welded vertically between the vertical legs of L-shaped chord members on the side opposite the web increase the rigidity of the structural beam. The open web is formed of one or more metal bars secured at longitudinally spaced intervals between the vertical leg portions of the L-shaped top and bottom chord members in a longitudinally extending diagonal configuration extending between the top and bottom chords. The Z-shaped beams may be nested for shipping and joined together to span greater distances than the single beams alone.

SUMMARY OF THE INVENTION

It is therefore an object of the present invention to provide a generally Z-shaped metal structural member having a top and bottom chord connected by open truss-like web members.

It is another object of this invention to provide a generally Z-shaped metal structural member having a top and bottom chord connected by open truss-like web members which is capable of being nested with like Z-shaped members for shipping and storage.

Another object of this invention is to provide a generally Z-shaped metal structural member having a top and bottom chord connected by open truss-like web members which can be secured to like Z-shaped members in a lapped condition to form a continuous structural framing member.

A further object of this invention is to provide a generally Z-shaped metal structural member having a top and bottom chord connected by open truss-like web members which can more efficiently and cost effectively replace both Z-purlins in metal building construction and metal bar joists in conventional building construction.

A still further object of this invention is to provide a generally Z-shaped metal structural member having a top and bottom chord connected by open truss-like web members which is simple in construction, economical to manufacture, and strong and reliable in use.

Other objects of the invention will become apparent from time to time throughout the specification and claims as hereinafter related.

The above noted objects and other objects of the invention are accomplished by an open web metal structural beam having a generally Z-shaped transverse cross section and is capable of being nested and joined in a lapped position with like beam members. The beam has a top chord defined by an elongate longitudinal angle having an L-shaped transverse cross section, a bottom chord member defined by an elongate longitudinal angle having a L-shaped transverse cross section. The top and bottom chords are secured by an open web member in vertically opposed relation with the vertical leg portions of the L-shapes aligned vertically and the horizontal leg portions of the L-shapes in laterally opposed relation and the laterally opposed longitudinal edges of the horizontal leg portions of the L-shapes are bent to form vertically opposed longitudinally extending stiffener lips on the chord members. One or more metal angle members welded vertically between the vertical legs of L-shaped chord members on the side opposite the web increase the rigidity of the structural beam. The open web is formed of one or more metal bars secured at longitudinally spaced intervals between the vertical leg portions of the L-shaped top and bottom chord members in a longitudinally extending diagonal configuration extending between the top and bottom chords. The Z-shaped beams may be nested for shipping and joined together to span greater distances than the single beams alone.

BRIEF DESCRIPTION OF THE DRAWINGS

FIGS. 7A and 7B are transverse cross section views of the "Z-bar" showing a single "Z-bar" prior to being nested and in the nested position respectively.

FIGS. 8A and 8B are elevation views illustrating the difference between a prior art simple span bar joist supported on a beam and column and the present "Z-bar" supported on beams.

DESCRIPTION OF THE PREFERRED EMBODIMENT

Figure 1:
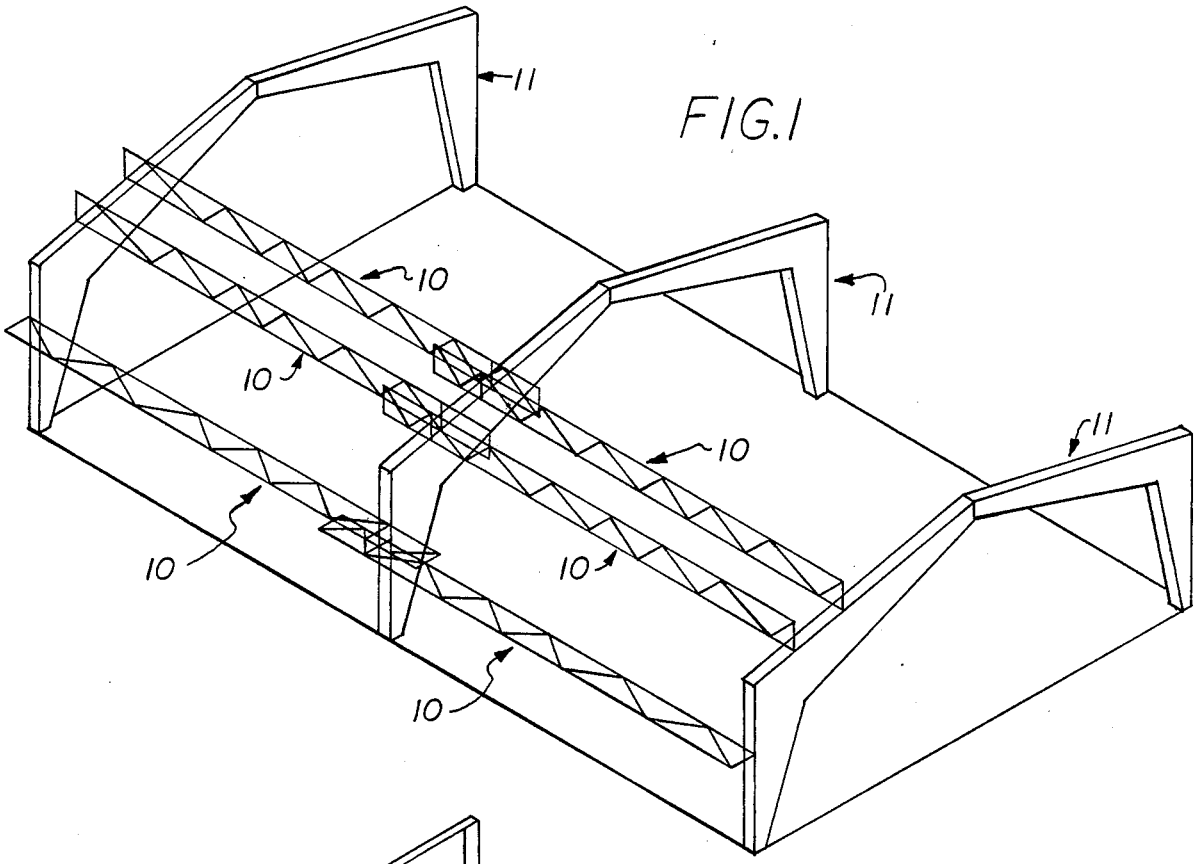
FIG. 1 is an isometric view illustrating schematically how the "Z-bar" in accordance with the present invention is used in a rigid frame metal building structure in the manner of conventional Z-purlins and Z-girts.
Figure 2:
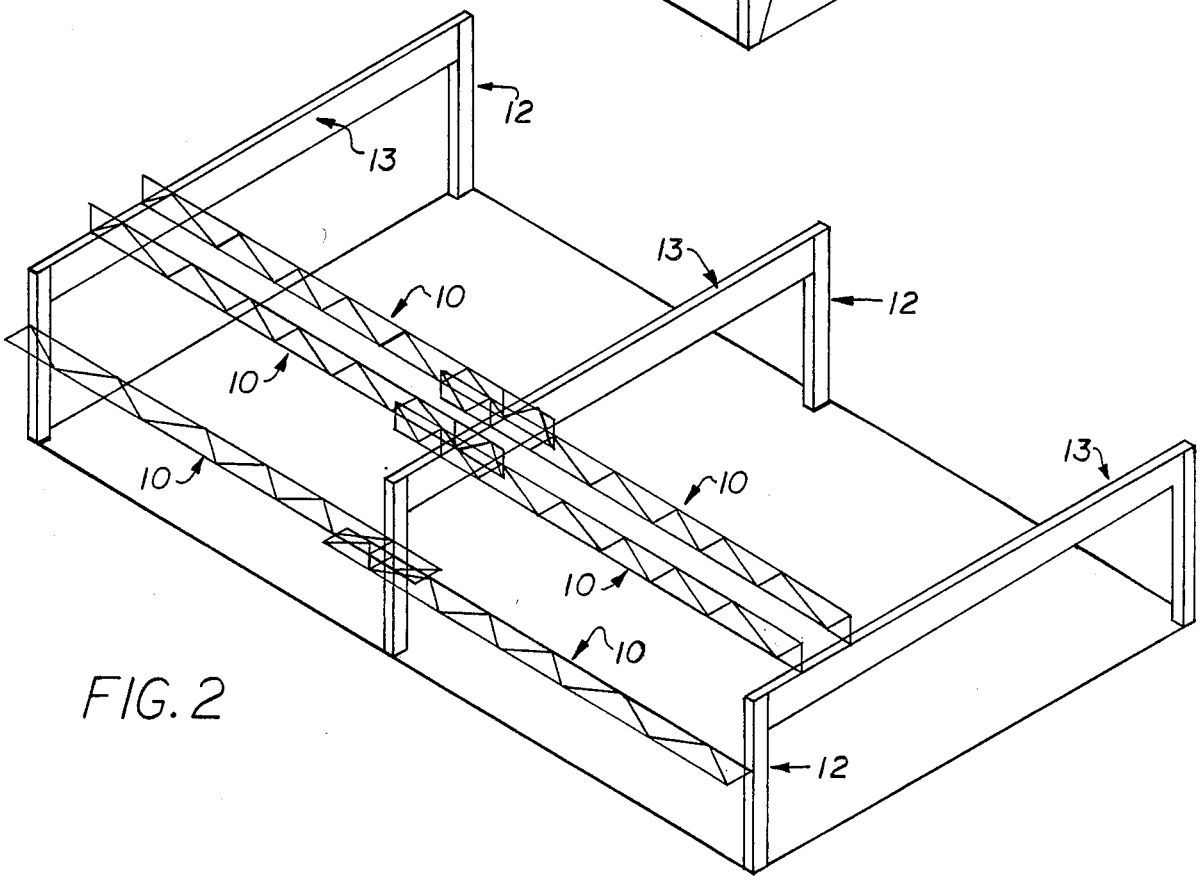
FIG. 2 is an isometric view illustrating schematically how the present "Z-bar" is used in a conventional post and beam building structure in the manner of conventional bar joists.

Referring to the drawings by numerals of reference, there is shown schematically in FIG. 1, several pairs of preferred structural metal members or "Z-bars" 10 in accordance with the present invention installed on the top portion of a metal bent 11 of a rigid frame metal building structure in the manner of conventional Z-purlins and on the side of the bent in the manner of a Z-girt. In FIG. 2, several pairs of the "Z-bars" 10 are installed on the top of a conventional post 12 and beam 13 building structure in the same manner as conventional bar joists and Z-girts. In FIGS. 1 and 2, each pair of "Z-bars" 10 are joined together in a lapped condition to form a continuous beam.

Figure 3:
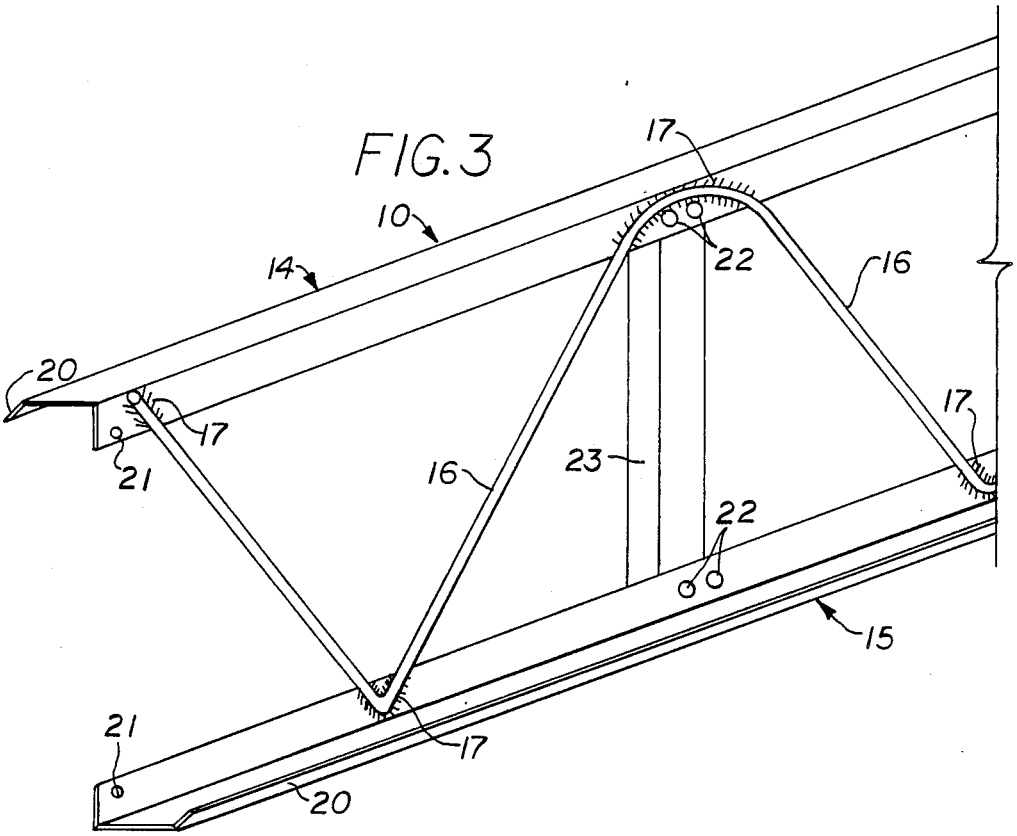
FIG. 3 is an isometric view of a portion of a preferred "Z-bar" in accordance with the present invention.
Figure 4A:
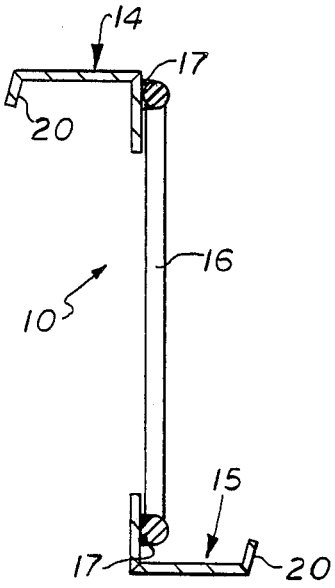
FIGS. 4A, 4B, and 4C are transverse cross section views of the "Z-bar" showing various methods of securing the web between the chord members.

As seen in FIGS. 3 and 4A, the present structural metal member or "Z-bar" 10 is formed of a top chord 14 and a bottom chord 15 connected together by a metal rod or bar 16 welded therebetween to form an open web between the chords 14 and 15. The chords 14 and 15 are elongate longitudinal angles having an L-shaped transverse cross section. The chords 14 and 15 are positioned in vertically opposed relation with the horizontal legs of the L-shapes laterally opposed. The bar 16 is bent in a longitudinally extending diagonal configuration and the top and bottom apex portions of the diagonal shape are welded 17 to the vertical leg of the L-shaped angles at longitudinally spaced intervals.

Figure 4B:
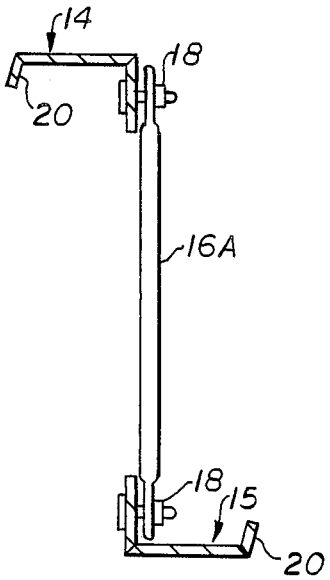
Figure 4C:
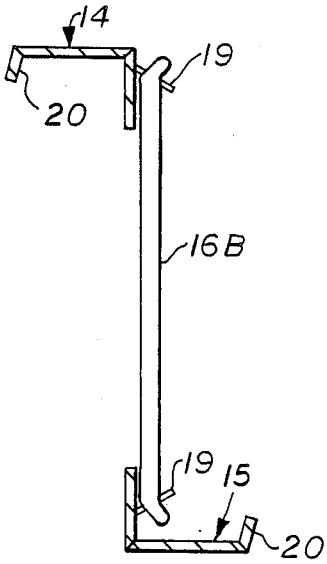

Alternatively, as seen in FIG. 4B, a bar 16A is bent in a longitudinally extending diagonal configuration and the top and bottom apex portions of the diagonal shape are flattened and bolted 18 to the vertical leg of the L-shaped angles at longitudinally spaced intervals. FIG. 4C shows another modification of the web member wherein the bar 16B is bent in a longitudinally extending diagonal configuration and the top and bottom apex portions of the diagonal shape are flattened and snap-locked 19 to the vertical leg of the L-shaped angles at longitudinally spaced intervals. It should be understood that the bars forming the web also be made of separate pieces or segments of round bar stock.

Figure 5:
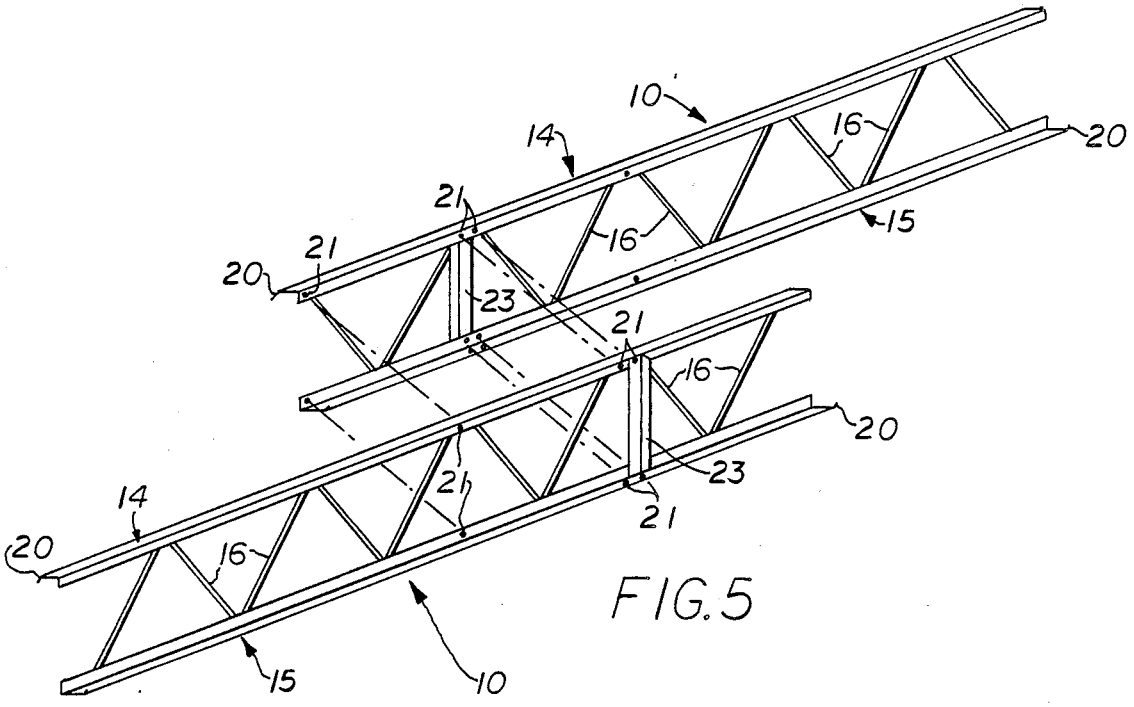
FIG. 5 is a partial isometric view of a pair of Z-bars illustrating how the members may be lapped and bolted at the ends and center of the laps.
Figure 6:
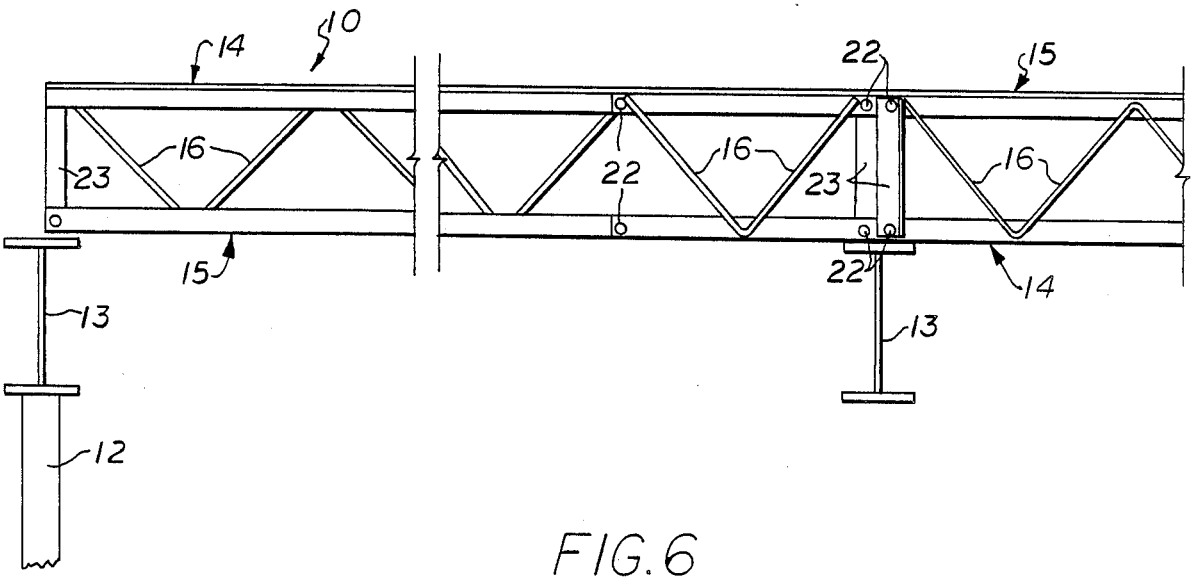
FIG. 6 is an elevation view of a pair of lapped "Z-bar" members supported on conventional beam and column support members and interior support members.

The assembled "Z-bar" unit 10 has a Z-shaped transverse cross section. The laterally opposed longitudinal edges of the horizontal leg of the L-shaped chords 14 and 15 are bent approximately 45 to 90 degrees relative to the horizontal axis to form a longitudinally extending stiffener lip 20 on each chord. Longitudinally spaced holes 21 are formed in the vertical leg of the chords 14 and 15 to receive bolts 22 for bolting one "Z-bar" 10 to another in a lapped joint. When two or more "Z-bars" 10 are so bolted together, a continuous beam is formed (FIGS. 5 and 6) which can carry down the length of the building. To achieve greater rigidity metal angles 23 are welded vertically between the vetical legs of L-shaped chords at the points at which the "Z-bar" 10 will be supported and at the location of the lapped joint.

As shown in FIGS. 7A and 7B, to position the "Z-bars" 10 in the lapped interlocking position, one "Z-bar" is placed directly against another in a 180 degree inverted relation. In this nested or lapped position, the top chord 14 of one "Z-bar" is nested inside, or, on top of the bottom chord 15 of the other "Z-bar" and the web bar members 16 and vertical angle members 23 are on laterally opposite sides of the assembly (FIG. 7B). The result of this nestability means approximately 40 percent more shipping efficiency in the case of Z-bars versus bar joists.

Referring again to FIG. 6, the present "Z-bar" 10 will fit on typical post 12 and beam 13 building support members. FIGS. 8A and 8B illustrate a comparison between a typical simple span bar joist 24 of the prior art. In FIG. 8A it can be seen that the conventional bar joist 24 can only span a predetermined distance, for example between the beam members 13, since they can not be lapped. In FIG. 8B three "Z-bars" 10 are joined in a lapped condition and form a continuous beam spanning three metal bent supports 11. The lapped, continuous span "Z-bar" provides approximately 50+% increased load capacity over a simple span where conditions are equal.

The open web Z-shaped metal structural member of the present invention is a major improvement over conventional "Z-purlins" and "bar joists" and offers an alternative structural beam for use in both conventional building and metal building construction. The open web construction allows greater depth variations than available with conventional "Z-purlins" and the L-shaped chords with stiffiner lips allows a nesting feature and lapped continuous beam spans not available with conventional "Z-purlins" and "bar-joists".

While this invention has been described fully and completely with special emphasis upon several preferred embodiments, it should be understood that within the scope of the appended claims the invention may be practiced otherwise than as specifically described herein.

We claim:

1. An open web nestable metal structural beam for use in building construction having a generally Z-shaped transverse cross section which is capable of being nested and joined in lapped relation with like beam members to form a continuous beam comprising;

a top chord member defined by an elongate longitudinal angle member having an L-shaped transverse cross section, a bottom chord member defined by an elongate longitudinal angle member having an L-shaped transverse cross section, said top and bottom chords disposed in vertically opposed relation with the vertical leg portions of the L-shapes aligned vertically and the horizontal leg portions of the L-shapes in laterally opposed relation, the laterally opposed longitudinal edges of the horizontal leg portions of the L-shapes bent angularly relative to the horizontal axis to form vertically opposed longitudinally extending stiffener lips on said chord members, said chord members and said stiffener lips being configured to receive or be received on identical chord members in a vertically inverted nested relation, one or more bar members secured at longitudinally spaced intervals to opposite sides of the opposed vertical leg portions of the L-shaped top and bottom chord members in a longitudinally extending diagonal configuration forming an open web extending between said top and bottom chords, one or more metal angle members welded vertically between the vertical legs of L-shaped chord members on the side opposite of said open web for increased rigidity of said structural beam in spanning horizontal distances, and longitudinally spaced holes formed in the vertical leg portions of the L-shaped chords to receive fastener means for joining one said structural beam to another identical said structural beam, said top and bottom chords, said open web, and said holes through said vertical leg portions being disposed relative to one another such that one said structural beam may be inverted and placed over an identical said structural beam to overlap a portion of their length in a nested 180° vertically inverted side-by-side lapped relation and secured by said fastener means received through said holes in said vertical leg portions to form a single continuous beam wherein said top chord of one beam is nested inside, or, on top of said bottom chord of the other beam and said web bar and vertical angle members are on laterally opposite sides of the assembly.

2. An open web metal structural beam according to claim 1 wherein;

said fastener means comprise bolt means installed through aligned holes of the vertical leg portions of said nested structural beams.

3. An open web metal structural beam according to claim 1 in which said one or more bar members comprises a single metal bar bent in a longitudinally extending alternating diagonal configuration and the top and bottom apex portions of the diagonal shape welded to opposite sides of the opposed vertical leg portions of the L-shaped top and bottom chord members at longitudinally spaced intervals forming an open web extending between said top and bottom chords.

4. An open web metal structural beam according to claim 1 in which said one or more bar members comprises a single metal bar bent in a longitudinally extending alternating diagonal configuration and the top and bottom apex portions of the diagonal shape are flattened and bolted to opposite sides of the opposed vertical leg portions of the L-shaped top and bottom chord members at longitudinally spaced intervals forming an open web extending between said top and bottom chords.

5. An open web metal structural beam according to claim 1 in which said one or more bar members comprises a single metal bar bent in a longitudinally extending alternating diagonal configuration and the top and bottom apex portions of the diagonal shape are flattened and snap-locked to opposite sides of the opposed vertical leg portions of the L-shaped top and bottom chord members at longitudinally spaced intervals forming an open web extending between said top and bottom chords.

6. An open web metal structural beam according to claim 1 in which said one or more bar members comprises a plurality of separate metal bar members disposed in a longitudinally extending alternating diagonal configuration and the top and bottom ends of the bar members welded to opposite sides of the opposed vertical leg portions of the L-shaped top and bottom chord members at longitudinally spaced intervals forming an open web extending between said top and bottom chords.

7. An open web metal structural beam according to claim 1 in which said one or more bar members comprises a plurality of separate metal bar members disposed in a longitudinally extending alternating diagonal configuration and the top and bottom ends of the bar members are flattened and bolted to opposite sides of the opposed vertical leg portions of the L-shaped top and bottom chord members at longitudinally spaced intervals forming an open web extending between said top and bottom chords.

8. An open web metal structural beam according to claim 1 in which said one or more bar members comprises a plurality of separate metal bar members disposed in a longitudinally extending alternating diagonal configuration and the top and bottom ends of the bar members are flattened and snap-locked to opposite sides of the opposed vertical leg portions of the L-shaped top and bottom chord members at longitudinally spaced intervals forming an open web extending between said top and bottom chords.

9. An open web metal nestable structural beam for use in building construction having a generally Z-shaped transverse cross section which is capable of being nested and joined in lapped relation with like beam members to form a continuous beam comprising;

a top chord member defined by an elongate longitudinal angle member having an L-shaped transverse cross section, a bottom chord member defined by an elongate longitudinal angle member having an L-shaped transverse cross section, said top and bottom chords disposed in vertically opposed relation with the vertical leg portions of the L-shapes aligned vertically and the horizontal leg portions of the L-shapes in laterally opposed relation, the laterally opposed longitudinal edges of the horizontal leg portions of the L-shapes bent angularly relative to the horizontal axis to form vertically opposed longitudinally extending stiffener lips on said chord members, said chord members and said stiffener lips being configured to receive or be received on identical chord members in a vertically inverted nested relation, a single metal bar bent in a longitudinally extending alternating diagonal configuration and the top and bottom apex portions of the diagonal shape welded to opposite sides of the opposed vertical portions of the opposed L-shaped top and bottom chord members at longitudinally spaced intervals forming an open web extending between said top and bottom chords, one or more metal angle members welded vertically between the vertical legs of L-shaped chord members on the side opposite said web for increased rigidity of said structural beam in spanning horizontal distances, and longitudinally spaced holes formed in the vertical leg portions of the L-shaped chords to receive bolts for joining one said structural beam to another identical said structural beam nested thereon in 180° vertically inverted side-by-side lapped relation to form a single continuous beam, said top and bottom chords, said open web, and said holes through said vertical leg portions being disposed relative to one another such that one said stuctural beam may be inverted and placed over an identical said structural beam to overlap a portion of their length in a nested 180° vertically inverted side-by-side lapped relation and secured by bolts received through said holes in said vertical leg portions to form a single continuous beam wherein said top chord of one beam is nested inside, or, on top of said bottom chord of the other beam and said web bar and vertical angle members are on laterally opposite sides of the assembly.

10. An open web metal continuous span structural beam assembly for use in building construction formed of two or more identical beams having a generally Z-shaped transverse cross section nested and joined in lapped relation to span greater distances than the single beams alone comprising;

at least two beam members each having a top chord member defined by an elongate longitudinal angle member having an L-shaped transverse cross section and a bottom chord member defined by an elongate longitudinal angle member having an L-shaped transverse cross section which is disposed in vertically opposed relation to the top chord with the vertical leg portions of the L-shaped angle members aligned vertically and the horizontal leg portions of the angle members in laterally opposed relation, the laterally opposed longitudinal edges of the horizontal leg portions of the angle members bent angularly relative to the horizontal axis to form vertically opposed logitudinally extending stiffener lips on said chord members, said chord members and said stiffener lips being configured to receive or be received on identical chord members in a vertically inverted nested relation, a single metal bar bent in a longitudinally extending alternating diagonal configuration and the top and bottom apex portions of the diagonal shape welded to opposite sides of the vertical leg portions of each said top and bottom chord members at longitudinally spaced intervals forming an open web extending between said top and bottom chords, one or more metal angle members welded vertically between the vertical legs of each said chord member on the side opposite the web for increased rigidity of said structural beam in spanning horizontal distances, and longitudinally spaced holes formed in the vertical leg portions of the L-shaped chord members for receiving bolt members therethrough, each said beam member secured one upon the other along a portion of their length by bolts received through axially aligned said holes and secured by nuts to join one said structural beam to another said structural beam nested thereon in 180° vertically inverted side-by-side lapped relation forming a single continuous beam wherein said top chord of one beam is nested inside, or, on top of said bottom chord of the other beam and said web bar and vertical angle members are on laterally opposite sides of the assembly, said assembly providing double beam strength at high moment points along the continuous beam spanning multiple support points.

* * * * *